US011694662B2

(12) United States Patent
Vukasinovic

(10) Patent No.: US 11,694,662 B2
(45) Date of Patent: Jul. 4, 2023

(54) MANUAL PULLING INSTRUMENT

(71) Applicant: Carboneon GmbH, Winterthur (CH)

(72) Inventor: Srdjan Vukasinovic, Winterthur (CH)

(73) Assignee: CARBONEON GMBH, Winterthur (CH)

( * ) Notice: Subject to any disclaimer, the term of this patent is extended or adjusted under 35 U.S.C. 154(b) by 0 days.

(21) Appl. No.: 17/552,776

(22) Filed: Dec. 16, 2021

(65) Prior Publication Data

US 2022/0208152 A1 Jun. 30, 2022

(30) Foreign Application Priority Data

Dec. 29, 2020 (DE) ..... 10 2020 216 588.2
Aug. 9, 2021 (EP) ..... 21190425

(51) Int. Cl.
*G10D 11/02* (2006.01)

(52) U.S. Cl.
CPC ..... *G10D 11/02* (2013.01)

(58) Field of Classification Search
CPC ..... G10D 11/02
See application file for complete search history.

(56) References Cited

U.S. PATENT DOCUMENTS 1,780,543 A * 11/1930 Stiegelmayer ..... G10D 11/02 84/376 R
1,908,247 A * 5/1933 Hohner ..... G10D 11/02 84/376 R
1,922,381 A * 8/1933 Luttbeg ..... G10D 11/00 84/376 R
2,072,985 A * 3/1937 Hofbauer ..... G10D 11/00 84/376 R
D108,612 S * 3/1938 Butti ..... 84/376 R
(Continued)

FOREIGN PATENT DOCUMENTS

DE 917533 C * 9/1954
DE 295 19 450 U1 5/1996
(Continued)

OTHER PUBLICATIONS

Office Action, for German Patent Application No. 10 2020 216 588.2, dated Apr. 4, 2021, 4 pages.
(Continued)

*Primary Examiner* — Robert W Horn
(74) *Attorney, Agent, or Firm* — Westman, Champlin & Koehler, P.A.

(57) ABSTRACT

A manual pulling instrument, in particular an accordion, comprising a first housing part comprising operating elements configured to be operated by a player with one hand to generate a note. The operating elements occupy a spatial area extending to a first boundary line on a first side and to a second boundary line on a second side opposite the first side, the second boundary line is further away from the bellows than the first boundary line, and the second boundary line has a concave curvature. The spatial area occupied by the operating elements extends in a plane which encloses an angle between 20° and 65°, with a center plane which extends symmetrically with respect to the bellows between the first housing part and the second housing part when the bellows is in a folded state.

20 Claims, 4 Drawing Sheets

(56) References Cited

U.S. PATENT DOCUMENTS

| | | | | | |
|---|---|---|---|---|---|
| 2,581,553 | A * | 1/1952 | Dellaira | G10D 11/02 | 84/376 R |
| 4,159,664 | A * | 7/1979 | Mastronardi | G10D 11/02 | 84/376 R |
| 4,545,276 | A * | 10/1985 | Curletto | G10H 1/32 | 84/718 |
| 4,884,488 | A * | 12/1989 | Curletto | G10H 1/32 | 984/344 |
| 4,953,436 | A * | 9/1990 | Curletto | G10H 1/0066 | 84/352 |
| 5,099,737 | A * | 3/1992 | Curletto | G10H 1/32 | 84/376 R |
| 5,388,493 | A * | 2/1995 | Curletto | G10H 1/0066 | 84/376 A |
| 10,733,967 | B2 * | 8/2020 | Trapp | G10D 11/00 | |
| 2019/0035368 | A1 | 1/2019 | Trapp et al. | | |
| 2022/0208152 | A1 * | 6/2022 | Vukasinovic | G10D 11/02 | |

FOREIGN PATENT DOCUMENTS

| | | |
|---|---|---|
| EP | 3 226 236 A1 | 10/2017 |
| EP | 3435368 B1 | 12/2020 |

OTHER PUBLICATIONS

Search report for European Patent Application No. 21190425.5, dated Jan. 26, 2022, 8 pages.

* cited by examiner

MANUAL PULLING INSTRUMENT

CROSS-REFERENCE TO RELATED APPLICATION(S)

This application claims priority to the German Patent Application No. 10 2020 216 588.2, filed on Dec. 29, 2020, and to the European Patent Application No. 21 190 425.5, filed on Aug. 9, 2021, the contents of which are incorporated herein by reference in their entireties.

BACKGROUND

The invention relates to a manual pulling instrument, for example in the form of an accordion, having a first housing part, a second housing part, and a bellows by which the first housing part and the second housing part are movably connected to each other.

There are various manual pulling instruments of this type. One of the housing parts is typically called the "treble housing", the other housing part is called the "bass housing". The treble housing comprises operating elements, usually in the form of keys (in the manner of piano keys) or in the form of press-buttons or buttons for short, which are configured to be operated by the player with the fingers of their right hand. The bass housing also comprises operating elements, usually in the form of buttons, configured to be operated by the player with the fingers of their left hand.

Basically, there is a risk for a player of a manual pulling instrument that they will become disadvantageously tense while playing. This can generally lead to health problems, in particular in the long run.

Furthermore, there is a need for a manual pulling instrument that allows for better playing from a health perspective.

SUMMARY

This object is achieved according to the present invention by the subject-matter of the independent claim. Advantageous embodiments with expedient further modifications of the invention are indicated in the subclaims, wherein advantageous embodiments of one aspect of the invention are to be regarded as mutually advantageous embodiments of the respective other aspects of the invention.

According to a first aspect of the invention, a manual pulling instrument, in particular an accordion, is provided which comprises a first housing part, a second housing part and a bellows by which the first housing part and the second housing part are movably connected to each other. The first housing part comprises operating elements which are configured to be operated by a player of the manual pulling instrument with one hand. The operating elements occupy a spatial area extending to a first boundary line on a first side and to a second boundary line on a second side opposite the first side, wherein the second boundary line is further away from the bellows than the first boundary line, and wherein the second boundary line has a concave curvature. The spatial area occupied by the operating elements extends, preferably at least to a first approximation, in a plane which encloses an angle of between 20° and 65°, preferably between 30° and 60°, with a center plane of the manual pulling instrument which extends symmetrically with respect to the bellows between the first housing part and the second housing part when the bellows is in a folded state.

Unless otherwise indicated herein, this description assumes an orientation of the manual pulling instrument as meant for playing the manual pulling instrument. In this sense, the center plane of the manual pulling instrument is a vertical plane. The plane in which the spatial area extends which is occupied by the operating elements is also preferably a vertical plane.

In a conventional manual pulling instrument, the spatial area occupied by the operating elements of the first housing part (treble housing) is overall—at least to a first approximation—rectangular in shape. When such an instrument is held by a player as intended, operating elements located in a spatially seen upper part of the spatial area, i.e. located "closer to the head", serve to generate low notes, while operating elements located in a lower part of the spatial area, i.e. located "closer to the floor", serve to generate high notes. If, when playing this instrument, a player moves their right hand from the lower part of the spatial area (high notes) towards the upper part of the spatial area (low notes), they usually first move their right elbow a little to the outside, more precisely to the right back, due to the rectangular shape of the spatial area. This requires a movement in the right shoulder joint in the sense of a combined retroversion and abduction. In the opposite direction, i.e., when the hand moves from the "low notes" to the "high notes", there is a corresponding movement in the opposite direction.

In contrast, the described concave design of the spatial area of the operating elements according to the invention makes it possible to achieve that the right elbow of the player has to move less than in the case of a conventional instrument. This entails that the player has to move and tense their right shoulder muscles less when playing.

Furthermore, in a conventional manual pulling instrument, the operating elements are configured in a plane that encloses an angle of typically 70° to 90° with the center plane of the instrument. In order to adjust the position of the right hand—with the wrist in a neutral position—to this spatial orientation of the operating elements, the player typically spreads their right elbow sideways away from their body. In addition, this requires them to rotate their arm comparatively far inwards at the shoulder joint, usually considerably further than 45°. This leads to playing movements that basically have an ergonomically unfavorable impact on the shoulder joint.

By contrast, the fact that the spatial area of the operating elements in a manual pulling instrument according to the invention extends in a plane which encloses an angle of between 20° and 65° with the center plane of the instrument, i.e. is orientated "more steeply", entails that the player can keep their right elbow—again with the wrist in a neutral position—closer to the body, i.e. closer in a more relaxed position. In this way, a significant relief of the shoulder muscles can be achieved, since abduction in the shoulder joint tends to be particularly critical from an ergonomic point of view. In addition, with the design of the manual pulling instrument according to the invention, the player has to rotate their arm less far inwards in the shoulder joint. For example, it can thus be achieved that an internal rotation is only required up to about 45° (in the horizontal plane), which also contributes to the relaxation of the shoulder joint.

In addition, compared to the conventional design, the concave shape and "steeper" orientation of the spatial area of the operating elements according to the invention results in that a central region of this spatial area is further away from an imaginary line between an eye of the player and the operating elements in the lower part of the spatial area (high notes). In this way, the player can better see the operating elements in the lower part (high notes). Due to the steeper orientation of the operating elements the player can better see the lower part of the spatial area (high notes) with the head in a neutral position, i.e., without stretching the head forward. This makes playing easier, in particular when practicing new movements, for example, when learning new musical pieces, as well as when making large tonal leaps.

In other words, with the conventional instrument, the player typically tends to stretch their head forward and to the right in order to better see the operating elements in the lower part (high notes). In contrast, due to the described better visibility in the case of the manual pulling instrument according to the invention, the player can keep their head in a more natural, physiologically more advantageous posture.

In this way, a manual pulling instrument according to the invention as a whole enables the player to adopt a considerably more natural posture of their right arm with their right hand and also a more natural posture of their head when playing the manual pulling instrument. An appropriate ergonomic posture has a significant health benefit, since it enables more relaxed, more natural music making. Additionally, the risk of developing playing-related injuries can be reduced thereby, in particular with regard to tendinitis, tendovaginitis, bursitis and muscular tension in the upper extremity, the neck and the upper back, culminating in task-specific focal dystonia, which, for example, has the potential to trigger the end of a professional musician's career.

Furthermore, with the design according to the invention, faster performance passages are basically better possible due to the easier accessibility of the operating elements. In addition, less fatigue and thus more enduring play is possible.

The first housing part can be in particular a treble housing. The second housing part can be in particular a bass housing. The operating elements can be, for example, keys, for example in the manner of piano keys. Alternatively, the operating elements can be, for example, buttons.

"Boundary line" of the spatial area is meant here to refer to an imaginary line which tangentially adapts to a plurality of, in particular more than two, operating elements which are arranged at the edge with respect to the group of operating elements formed by the operating elements. In particular, the operating elements can be configured such that the spatial area occupied by the operating elements can be completely delimited by four boundary lines. For example, the first boundary line and the second boundary line can each be longer than the remaining two boundary lines. For example, the spatial area can be in the form of an annular disk section, wherein the first boundary line and the second boundary line represent respective circular arc sections.

In particular, the operating elements are designed such that, when the bellows is moving, pressing the operating elements causes the generation of a sound. Preferably, the spatial area is formed by all operating elements of the first housing part. This means that in this sense no further operating element of the first housing part is located outside the spatial area occupied by the operating elements.

Preferably, the angle between the plane of the spatial area and the center plane of the manual pulling instrument is between 30° and 60°, for example, between 35° and 55°. This is particularly advantageous because in this way the right elbow can be kept particularly still and thus a more relaxed posture can be adopted in the right shoulder joint.

Preferably, the concave curvature of the second boundary line has, at least in sections, a radius of curvature that is between 15 cm and 35 cm, preferably between 20 cm and 30 cm. For example, the concave curvature of the second boundary line can predominantly have a radius of curvature which is between 15 cm and 35 cm, preferably between 20 cm and 30 cm. This type of curvature allows in a particularly suitable way that the player can move their right elbow naturally and thus relieve the shoulder joint, since the latter can remain in the normal zero position+/−10° of abduction and without too much inward rotation.

Preferably, the first boundary line also has a concave curvature. "Concave" is meant to express that the direction of curvature of the first boundary line is formed in the same way as that of the second boundary line. In other words, the first boundary line preferably has a curvature shaped such that an upper end portion and a lower end portion of the first boundary line are spaced further apart from the bellows than a central region of the first boundary line. In this way, the spatial area of the operating elements can be advantageously formed, for example, in the shape of an annular disk section. In particular, for this purpose, the concave curvature of the first boundary line can be congruent, at least to a first approximation, with the concave curvature of the second boundary line. The first and second boundary lines of the spatial area can be shaped, for example, in the sense of parallel curves.

More generally, the ergonomic advantages described above can basically already be achieved if only the first boundary line is curved as described, but not the second boundary line. This means that the second boundary line does not necessarily have to be curved as well for this purpose.

Preferably, the curvature of the first boundary line has, at least in sections, a radius of curvature that is between 15 cm and 35 cm, preferably between 20 cm and 30 cm. For example, the curvature of the first boundary line can predominantly have a radius of curvature that is between 15 cm and 35 cm, preferably between 20 cm and 30 cm. This type of curvature allows in a particularly suitable way that the player can move their right elbow naturally and thus relieve the shoulder joint, since the latter can remain in the normal zero position+/−10° of abduction and without too much inward rotation.

Preferably, the operating elements are arranged along a plurality of concavely curved lines. In this context, a concave curvature of the lines can be congruent, at least to a first approximation, with the concave curvature of the first boundary line and/or the second boundary line. This is particularly advantageous, for example, when the operating elements are configured in the form of buttons.

Preferably, the first housing part has a concave curvature on a side facing away from the bellows. Further preferably, this concave curvature of the first housing part is congruent, at least to a first approximation, with the concave curvature of the second boundary line. This further facilitates the accessibility of the player's right hand to the operating elements.

If the player keeps their right elbow (in the sense of the so-called neutral zero method) still in the neutral position, i.e., "next to the torso", and moves their right hand up and down in a circular arc, the hand at the upper end of this movement—due to the muscular stop between the upper arm and forearm—reaches less far towards the back or "rearwards" than at the lower end. Therefore, it is ergonomically advantageous if the spatial area occupied by the operating elements extends less far rearwards with its upper end than with its lower end. In this sense, the first housing part preferably comprises a rear surface area configured to face the torso of the player, wherein an upper end of the spatial area occupied by the operating elements is formed further away from the rear surface area than a lower end of the spatial area. In this way, it can be achieved, for example, that the player can cover the entire spatial area of the operating elements by a movement of their right forearm around the elbow joint held in the neutral position between about 30° and 120° (according to the neutral-zero method, i.e., 0° corresponds to vertically downward). This is a physiologically and/or ergonomically particularly advantageous range of movement.

More generally, the latter advantage can be achieved irrespective of the plane or area in which the spatial area occupied by the operating elements extends.

Preferably, the first housing part comprises a rear surface area configured to face the torso of the player, wherein the rear surface area is concave in shape. In particular, a radius of curvature of said rear surface area is, at least in sections, between 0.5 m and 3 m. By this design, it can be achieved that the manual pulling instrument can better snuggle to the torso of the player during playing. This improves the player's ability to control the manual pulling instrument when holding it.

Furthermore, it can be achieved in this way that the center of gravity of the manual pulling instrument can be positioned closer to the spine of the player. This can produce a relief, in particular of the player's back. Moreover, also in this way the visibility of the operating elements is further enhanced. In addition, it is achieved in this way that the player together with the manual pulling instrument demands less space as a whole. As a further consequence, this results in a reduced risk of an unintentional striking of the manual pulling instrument against a person or an object in the environment of the player. In addition, the player can position any sheets of music provided for playing closer to their face so that they can better see the notes. Moreover, the accessibility of the right hand to the operating elements is further facilitated in this way.

Preferably, the second housing part comprises a rear surface area configured to face the torso of the player, wherein said rear surface area is concave in shape. Preferably, a radius of curvature of said rear surface area is, at least in sections, between 0.5 m and 3 m. In this way, the advantageous effects described above with reference to the corresponding concave shape of the first housing part become even more pronounced.

Preferably, the second housing part comprises further operating elements, which are arranged in particular in an indentation formed by the second housing part, wherein the further operating elements occupy a further spatial area, which extends to a first boundary line on a first side and to a second boundary line on a second side opposite the first side, wherein the second boundary line is further away from the bellows than the first boundary line, wherein the second boundary line has a concave curvature and wherein the further spatial area occupied by the further operating elements extends in a further plane, which encloses a further angle of between 0° and 50°, preferably between 0° and 40°, for example between 0° and 30°, with the center plane of the manual pulling instrument. In other words, the design with respect to the further operating elements, i.e., "on the left side", is basically analogous to the corresponding design with respect to the first-mentioned operating elements, but with the difference that the plane of the further spatial area is oriented "more steeply", i.e., encloses a smaller angle with the center plane of the instrument. This is advantageous because, when playing, the player's left hand typically moves further away from the player's torso, due to the movement involved in expanding the bellows, and thus the steeper orientation of the further plane entails that the left wrist does not have to be flexed as much from its neutral position—in the sense of a palmar flexion.

In this connection, the concave curvature of the second boundary line of the further spatial area preferably has, at least in sections, a radius of curvature which is between 5 cm and 25 cm, preferably between 7 cm and 20 cm. This radius of curvature is thus smaller than the corresponding radius of curvature on the right-hand side. This is advantageous because the player's left forearm is generally put between the second housing part or bass housing and a strap in order to be able to expand the bellows, and therefore the left elbow—compared to the right side—is significantly less flexed and extended for playing. For this reason, the player typically moves the wrist more here in order to be able to operate the other operating elements with the fingers. Thus, a stronger curvature, i.e., a smaller radius of curvature, is ergonomically more advantageous here.

Preferably, the first housing part has an outer surface configured to be opposite the torso of the player when the manual pulling instrument is held as intended, wherein the outer surface has formed therein at least one sound exit aperture configured to emit a note generated by an actuation of the bellows. This is advantageous because in this way, notes generated by the manual pulling instrument can be better emitted towards a listener, who is correspondingly opposite the player of the manual pulling instrument.

Preferably, the at least one sound exit aperture is the only exit aperture of the manual pulling instrument configured to emit notes generated by an actuation of the bellows. In this way, a particularly uniform emission of the notes can be achieved.

As shown above, the spatial area occupied by the operating elements extends, at least to a first approximation, in a plane. Thus, the spatial area does not necessarily have to extend exactly in the plane, but can also be configured such that it has a correspondingly slight convex and/or concave curvature with respect to said plane. Preferably, the maximum distance of the spatial area from the plane is at most 30%, more preferably at most 20%, of a distance between the first boundary line and the second boundary line.

For example, this slight curvature can be configured such that the spatial area of the operating elements curves outwardly in a vertically central region of the spatial area, with respect to an orientation of the manual pulling instrument intended for play. This further improves the features of the manual pulling instrument with respect to ergonomics. Alternatively or additionally, it can be provided that the spatial area of the operating elements curves slightly inwards in a lower part of the spatial area (i.e. at the "high notes"). The latter improves the visibility of the operating elements in the lowest part of the spatial area.

According to a further aspect of the invention, a manual pulling instrument, in particular an accordion, is provided which comprises a first housing part, a second housing part and a bellows by which the first housing part and the second housing part are movably connected to each other. The first housing part comprises operating elements which are configured to be operated by a player of the manual pulling instrument with one hand. The operating elements occupy a spatial area extending to a first boundary line on a first side and to a second boundary line on a second side opposite the first side, wherein the second boundary line is further away from the bellows than the first boundary line, and wherein the second boundary line has a concave curvature. The spatial area occupied by the operating elements extends in a curved surface which defines a hypothetical center plane which encloses an angle of between 20° and 65°, preferably between 30° and 60°, with the center plane of the manual pulling instrument which extends symmetrically with respect to the bellows between the first housing part and the second housing part when the bellows is in a folded state.

Preferably, the hypothetical center-plane is defined by the fact that for all points (x, y, z) of the curved surface, the sum of the squares of the distances between (x, y, z) and the hypothetical center plane is minimal.

Moreover, the formation of the spatial area of the operating elements along a curved surface can also be advantageously provided without a reference to the center plane of the manual pulling instrument. In this sense, more generally speaking, it is advantageous if the operating elements of the first housing part occupy a spatial area extending in a curved surface S, wherein the curved surface S has a convex and/or a concave curvature with respect to the first housing part. In this context, the curved surface is preferably shaped such that the spatial area has a convex curvature in a central region 5 with respect to a vertical direction as shown in FIG. 5. Further preferably the convex curvature has a radius of curvature which is between 0.5 m and 10 m, particularly preferably between 0.7 m and 5 m.

Preferably, the curved surface S is shaped such that the spatial area has a concave curvature in a lower region 7 with respect to a vertical direction, wherein preferably the concave curvature has a radius of curvature that is between 0.5 m and 10 m, particularly preferably between 0.7 m and 5 m.

In particular, the present application comprises the following aspects:

1. A manual pulling instrument, in particular an accordion, comprising:
   a first housing part comprising operating elements which are configured to be operated by a player of the manual pulling instrument with one hand;
   a second housing part; and
   a bellows by which the first housing part and the second housing part are movably connected to each other;
   wherein the operating elements occupy a spatial area extending to a first boundary line on a first side and to a second boundary line on a second side opposite the first side, wherein the second boundary line is further away from the bellows than the first boundary line, and wherein the second boundary line has a concave curvature, and wherein the spatial area occupied by the operating elements extends in a curved surface which defines a hypothetical center plane T which encloses an angle of between 20° and 65°, preferably between 30° and 60°, with a center plane M of the manual pulling instrument which extends symmetrically with respect to the bellows between the first housing part and the second housing part when the bellows is in a folded state.
2. The manual pulling instrument according to aspect 1, wherein the concave curvature of the second boundary line has, at least in sections, a radius of curvature that is between 15 cm and 35 cm, preferably between 20 cm and 30 cm.
3. The manual pulling instrument according to any one of the preceding aspects, wherein the first boundary line has a concave curvature.
4. The manual pulling instrument according to aspect 3, wherein the concave curvature of the first boundary line is congruent, at least to a first approximation, with the concave curvature of the second boundary line.
5. The manual pulling instrument according to any one of the preceding aspects, wherein the operating elements are arranged along a plurality of concavely curved lines.
6. The manual pulling instrument according to aspect 5, wherein the concave curvature of the lines is congruent, at least to a first approximation, with the concave curvature of the first boundary line and/or the second boundary line.
7. The manual pulling instrument according to any one of the preceding aspects, in which the first housing part has a concave curvature on a side facing away from the bellows.
8. The manual pulling instrument according to aspect 7, wherein the concave curvature on the side of the first housing part facing away from the bellows is congruent, at least to a first approximation, with the concave curvature of the second boundary line.
9. The manual pulling instrument according to any one of the preceding aspects, in which the first housing part comprises a rear surface area configured to face the torso of the player, wherein an upper end of the spatial area occupied by the operating elements is formed further away from the rear surface area than a lower end of the spatial area.
10. The manual pulling instrument according to any one of the preceding aspects, in which the first housing part comprises a rear surface area configured to face the torso of the player, wherein the rear surface area is concave in shape, wherein preferably a radius of curvature of said rear surface area is, at least in sections, between 0.5 m and 3 m.
11. The manual pulling instrument according to any one of the preceding aspects, in which the second housing part comprises a rear surface area configured to face the torso of the player, wherein the rear surface area is concave in shape, wherein preferably a radius of curvature of said rear surface area is, at least in sections, between 0.5 m and 3 m.
12. The manual pulling instrument according to any one of the preceding aspects, in which the second housing part comprises further operating elements, which are arranged in particular in an indentation formed by the second housing part, wherein in particular the further operating elements occupy a further spatial area, which extends to a first boundary line on a first side and to a second boundary line on a second side opposite the first side, wherein the second boundary line is further away from the bellows than the first boundary line, wherein the second boundary line has a concave curvature and wherein the further spatial area occupied by the further operating elements extends in a further plane, which encloses a further angle of between 0° and 50°, preferably between 0° and 40°, for example between 0° and 20°, with the center plane of the manual pulling instrument.
13. The manual pulling instrument according to aspect 12, wherein the concave curvature of the second boundary line of the further spatial area has, at least in sections, a radius of curvature which is between 5 cm and 25 cm, preferably between 7 cm and 20 cm.
14. The manual pulling instrument according to any one of the preceding aspects, in which the first housing part has an outer surface configured to be opposite the torso of the player when the manual pulling instrument is held as intended, wherein the outer surface has formed therein at least one sound exit aperture configured to emit a note generated by an actuation of the bellows.
15. The manual pulling instrument according to aspect 14, in which the at least one sound exit aperture is the only exit aperture of the manual pulling instrument configured to emit notes generated by an actuation of the bellows.

16. A manual pulling instrument, in particular an accordion, comprising:
   a first housing part comprising operating elements which are configured to be operated by a player of the manual pulling instrument with one hand;
   a second housing part; and
   a bellows by which the first housing part and the second housing part are movably connected to each other;
   wherein the operating elements occupy a spatial area extending in a curved surface, wherein the surface has a convex and/or a concave curvature with respect to the first housing part.
17. The manual pulling instrument according to aspect 16, in which the curved surface is shaped such that the spatial area has a convex curvature in a central region with respect to a vertical direction, wherein preferably the convex curvature has a radius of curvature which is between 0.5 m and 10 m, particularly preferably between 0.7 m and 5 m.
18. The manual pulling instrument according to aspect 16 or 17, in which the curved surface is shaped such that the spatial area has a concave curvature in a lower region with respect to a vertical direction, wherein preferably the convex curvature has a radius of curvature which is between 0.5 m and 10 m, particularly preferably between 0.7 m and 5 m.
19. A manual pulling instrument, in particular an accordion, comprising:
   a first housing part comprising operating elements which are configured to be operated by a player of the manual pulling instrument with one hand;
   a second housing part; and
   a bellows by which the first housing part and the second housing part are movably connected to each other;
   wherein the operating elements occupy a spatial area extending to a first boundary line on a first side and to a second boundary line on a second side opposite the first side, wherein the second boundary line is further away from the bellows than the first boundary line, and wherein the first boundary line has a curvature shaped such that an upper end portion and a lower end portion of the first boundary line are spaced further apart from the bellows than a central region of the first boundary line
20. The manual pulling instrument according to aspect 19, in which the curvature of the first boundary line has, at least in sections, a radius of curvature that is between 15 cm and 35 cm, preferably between 20 cm and 30 cm.
21. A manual pulling instrument, in particular an accordion, comprising:
   a first housing part comprising operating elements which are configured to be operated by a player of the manual pulling instrument with one hand;
   a second housing part; and
   a bellows by which the first housing part and the second housing part are movably connected to each other;
   wherein the first housing part has an outer surface configured to be opposite the torso of the player when the manual pulling instrument is held as intended, wherein the outer surface has formed therein at least one sound exit aperture, wherein the configuration is such that a note generated by an actuation of the bellows is emitted through the at least one sound exit aperture.
22. The manual pulling instrument according to aspect 21, in which a plurality of sound exit apertures are provided.
23. The manual pulling instrument according to aspect 21 or 22, in which the at least one sound exit aperture is the only exit aperture of the manual pulling instrument configured to emit notes generated by an actuation of the bellows.
24 A manual pulling instrument, in particular an accordion, comprising:
   a first housing part (2) comprising operating elements (4) which are configured to be operated by a player of the manual pulling instrument with one hand;
   a second housing part (6); and
   a bellows (8) by which the first housing part (2) and the second housing part (6) are movably connected to each other;
   wherein the operating elements (4) occupy a spatial area extending to a first boundary line (12) on a first side and to a second boundary line (14) on a second side opposite the first side, wherein the second boundary line (14) is further away from the bellows (8) than the first boundary line (12), and wherein the second boundary line (14) has a concave curvature, and
   wherein the second housing part (2) comprises a rear surface area (26) configured to face the torso of the player, wherein an upper end (42) of the spatial area occupied by the operating elements (4) is formed further away from the rear surface area (26) than a lower end (44) of the spatial area Further advantages, features and details of the invention can be deduced from the following description of a preferred embodiment as well as from the Figures. The features and combinations of features mentioned above in the description as well as the features and combinations of features mentioned below in the description of the Figures and/or shown alone in the Figures can be used not only in the combinations indicated in each case, but also in other combinations or alone, without departing from the scope of the invention.

DETAILED DESCRIPTION

Figure 1:
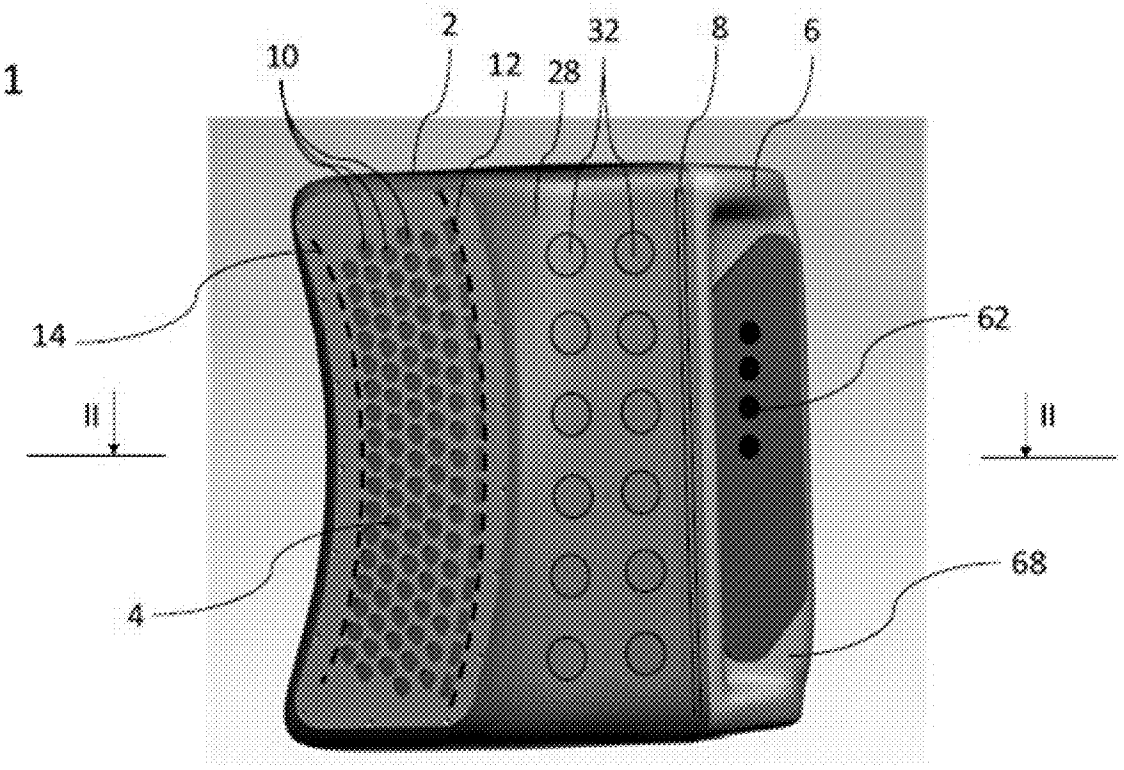
FIG. 1 shows a schematic drawing of a manual pulling instrument according to the present application.

FIG. 1 shows a schematic drawing of the manual pulling instrument with designations of different parts of the manual pulling instrument.

The manual pulling instrument, hereinafter also referred to as the instrument for short, comprises a first housing part 2, a second housing part 6 and a bellows 8 by which the first housing part 2 and the second housing part 6 are movably connected to each another. The first housing part 2 can be in particular a treble housing. The second housing part 6 can be in particular a bass housing.

The manual pulling instrument can further comprise a carrying strap attached to the first housing part 2, which is intended to be hung around the shoulders by the player for easier carrying the instrument.

The first housing part 2 comprises operating elements 4 configured to be operated by a player of the instrument with the right hand. The operating elements 4 can be, for example, keys or buttons or pushbuttons. The operating elements 4 occupy a spatial area which extends to a first boundary line 12 on a first side and to a second boundary line 14 on a second side opposite the first side. As revealed by the Figure, the second boundary line 14 is further away from the bellows 8 than the first boundary line 12. The first boundary line 12 adapts tangentially to an outer row of operating elements formed by part of the operating elements 4. On a side opposite this outer row of operating elements, the second boundary line 14 adapts tangentially to a further outer row of operating elements formed by a further part of the operating elements 4.

Figure 3:
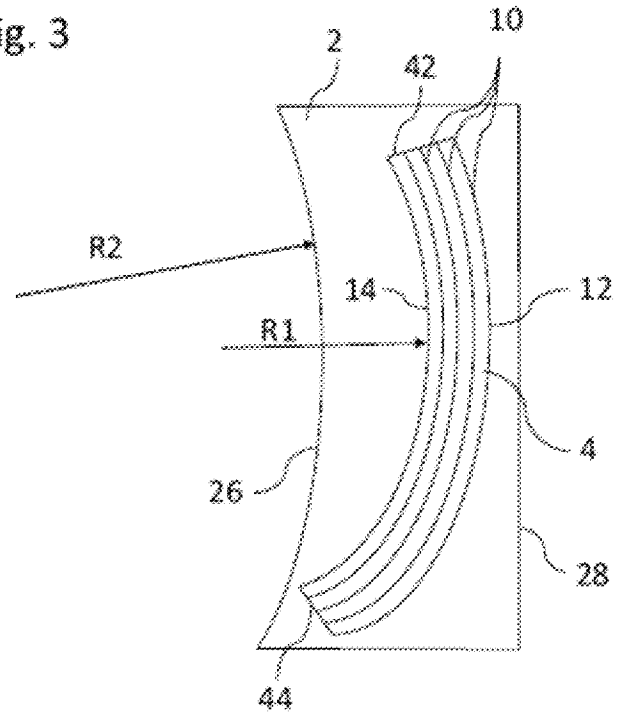
FIG. 3 shows a sketch of a side view of the first housing part.
Figure 5:
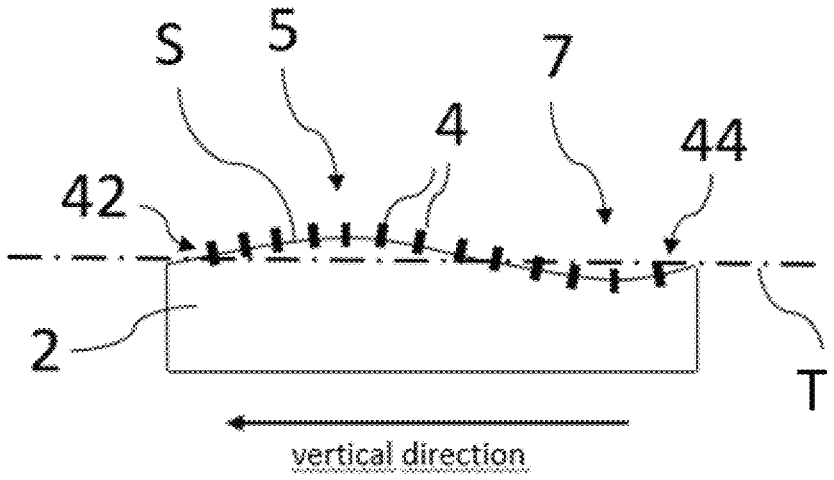
FIG. 5 shows a sketch of a section of a side view of the first housing part.

The second boundary line 14 has, at least in sections, a concave curvature. Preferably, the second boundary line 14 is concavely curved as a whole, for example uniformly concavely shaped. FIG. 3 shows a sketch of a side view of the operating elements 4 of the first housing part 2. The concave curvature of the second boundary line 14 preferably has, at least in sections, a radius of curvature R1 which is between 15 cm and 35 cm, in particular between 20 cm and 30 cm.

As indicated in FIG. 3, a lower end 44 of the spatial area occupied by the operating elements 4 preferably extends further rearwards, i.e., further in the direction of a rear surface area 26 of the first housing part 2 than an upper end 42 of the spatial area. In other words, in the case of a circular arc-shaped boundary line 14, the central or mirror axis of the circular arc would not be oriented horizontally, but (in FIG. 3) slightly downwards to the right.

Figure 2:
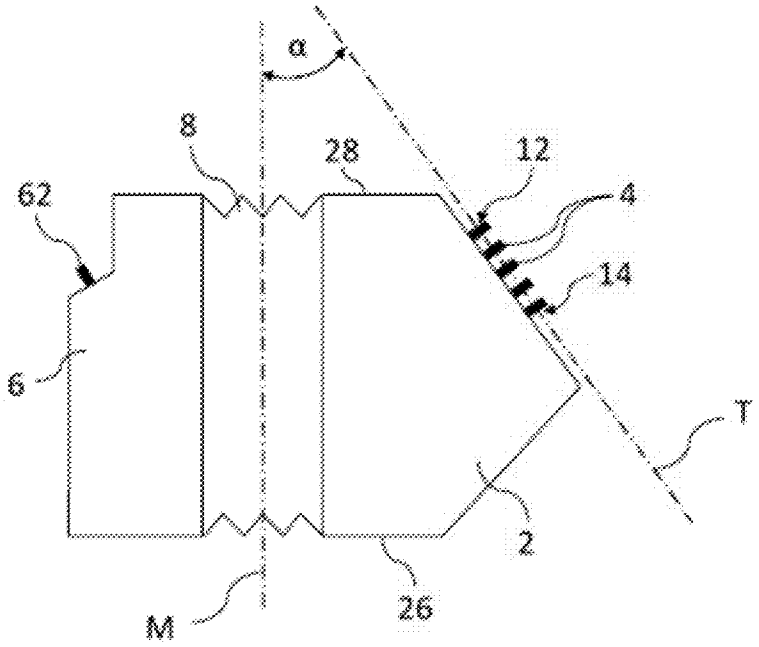
FIG. 2 shows a sketch of a view of the manual pulling instrument from the top in order to illustrate a plane in which a spatial area extends which is occupied by the operating elements.

FIG. 2 shows a schematic sketch of a view of the instrument from the top. The spatial area occupied by the operating elements 4 extends in a plane T which encloses an angle $\alpha$ of between 20° and 65°, preferably between 30° and 60°, with a center plane M of the instrument which extends symmetrically with respect to the bellows 8 between the first housing part 2 and the second housing part 6 when the bellows 8 is in a folded state. For example, the angle $\alpha$ can be between 35° and 55°.

As shown in particular in FIG. 1, preferably also the first boundary line 12 has a concave curvature. Preferably, the concave curvature of the first boundary line 12 is congruent, at least to a first approximation, with the concave curvature of the second boundary line 14. For example, the two boundary lines 12, 14 can have parallel curvatures.

As outlined in FIGS. 1 and 3, it can be advantageously provided that the operating elements 4 are arranged along a plurality of concavely curved lines 10. In this context, the concave curvature of the lines 10 is congruent, at least to a first approximation, with the concave curvature of the first boundary line 12 and/or the second boundary line 14. In particular, the first boundary line 14, the second boundary line 12 and/or the lines 10 can represent parallel curves. The number of lines can be, for example, between three and ten, preferably between three and seven.

Advantageously, the first housing part 2 can be concavely curved on a side facing away from or opposite the bellows 8, i.e. on a side which faces the player's right forearm when the instrument is held as intended. In this way, the accessibility of the right hand of the player to the operating elements 4 is facilitated or improved. For this purpose, this concave curvature of the first housing part 2 is preferably designed to be congruent, at least to a first approximation, with the concave curvature of the second boundary line 14.

In order to further facilitate and improve holding of the instrument, the first housing part 2 can comprise a rear surface area 26 intended to face the torso of the player, wherein the surface area 26 is concave in shape, as outlined in FIG. 3. Preferably, this surface area 26 has, at least in sections, a radius of curvature R2 which is between 0.5 m and 3 m, for example between 0.5 m and 2 m. (In FIG. 3 the radii of curvature R1, R2 are only schematically indicated).

In the example shown, the rear surface area 26 facing the torso of the player has said concave shape when viewed in a vertical section. Said curvature preferably extends over the entire vertical extension of the surface area 26, for example over at least 80%, preferably over at least 90% of the entire vertical extension of the manual pulling instrument.

It can further be provided that the rear surface area 26 of the first housing part 2 facing the body of the player has also a concave shape in a horizontal section (not shown in the Figures). This also supports easier holding of the instrument.

Figure 4:
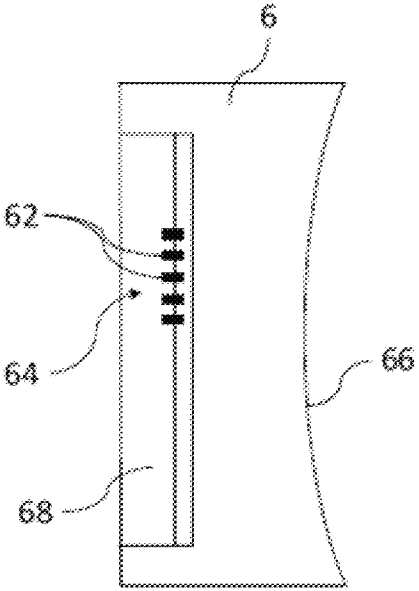
FIG. 4 shows a sketch of a side view of the second housing part.

Holding the instrument is further facilitated if, as outlined in FIG. 4, the second housing part 2 also has a rear surface area 66 intended to face the body of the player, wherein said rear surface area 66 of the second housing part 6 is concave in shape. Again, this surface area 66 of the second housing part 6 can have, at least in sections, a radius of curvature of between 0.5 m and 3 m. In particular, the concavity can be shaped according to the concavity of the surface area 26 of the first housing part 2 facing the torso of the player.

The first housing part 2 has a "forward" facing outer surface 28, which is configured to be opposite the torso of the player when the manual pulling instrument is held as intended. Preferably, at least one sound exit aperture 32 is formed in this outer surface 28, wherein the design is such that a note generated by an actuation of the bellows 8 is emitted through the at least one sound exit opening 32. In particular, a plurality of sound exit apertures 32 can be provided. In this way, an advantageous emission of the notes generated by the instrument is achieved. In this respect, it is particularly advantageous if the at least one sound exit aperture 32 is the only exit aperture of the manual pulling instrument which is configured to emit notes generated by an actuation of the bellows 8.

Preferably, the second housing part 6 additionally comprises further operating elements 62, in particular in the form of buttons. These further operating elements 62 can be arranged in an indentation 68 formed by the second housing part 6. According to a variant (not shown in the Figures), the further operating elements 62 occupy a further spatial area, which is basically designed analogously to the first-mentioned spatial area, wherein, however, the values for the corresponding curvature and angle of the plane of the further spatial area differ from the corresponding values on the side of the first housing part.

In particular, it can be provided that the further spatial area extends to a first boundary line on a first side and to a second boundary line on a second side opposite the first side, wherein the second boundary line is further away from the bellows 8 than the first boundary line and wherein the second boundary line has a concave curvature. Preferably the concave curvature of the second boundary line has, at least in sections, a radius of curvature which is between 5 cm and 25 cm, preferably between 7 cm and 20 cm.

The plane in which the further spatial area extends preferably encloses a further angle of between 0° and 50°, in particular between 0° and 40°, for example between 0° and 30°, with the center plane M of the manual pulling instrument.

This is advantageous because in this way physiologically and ergonomically more favorable movements during play are made possible, in particular also with regard to the player's left arm. Compared to the right side, however, a further range of movement in the left shoulder must be "allowed" here, because a correspondingly further abduction in the left shoulder is absolutely necessary for opening the bellows.

The invention claimed is:

1. A manual pulling instrument; comprising:

a first housing part comprising operating elements which are configured to be operated by a player of the manual pulling instrument with one hand;

a second housing part; and a bellows by which the first housing part and the second housing part are movably connected to each other;

wherein the operating elements occupy a spatial area extending in a curved surface, wherein the curved surface has a convex curvature and a concave curvature with respect to the first housing part.

2. The manual pulling instrument according to claim 1, wherein the curved surface is shaped such that the spatial area has the convex curvature in a central region of the spatial area with respect to a vertical direction.

3. The manual pulling instrument according to claim 2, wherein the convex curvature has a radius of curvature which is between 0.5 m and 10 m.

4. The manual pulling instrument according to claim 3, wherein the radius of curvature of the convex curvature is between 0.7 m and 5 m.

5. The manual pulling instrument according to claim 1, wherein the curved surface is shaped such that the spatial area has the concave curvature in a lower region of the spatial area with respect to a vertical direction.

6. The manual pulling instrument according to claim 5, wherein the concave curvature has a radius of curvature which is between 0.5 m and 10 m.

7. The manual pulling instrument according to claim 6, wherein the radius of curvature of the concave curvature is between 0.7 m and 5 m.

8. The manual pulling instrument according to claim 1, wherein the operating elements that occupy the spatial area extend to a first boundary line on a first side and to a second boundary line on a second side opposite the first side, wherein the second boundary line is further away from the bellows than the first boundary line, and wherein the second boundary line has a concave curvature.

9. The manual pulling instrument according to claim 1, further comprising a hypothetical center plane to which the curved surface is defined about, wherein the hypothetical center plane is positioned at an angle of between 20° and 65° from a center plane of the manual pulling instrument which extends symmetrically with respect to the bellows between the first housing part and the second housing part when the bellows is in a folded state.

10. The manual pulling instrument according to claim 9, wherein the angle between the hypothetical center plane and the center plane of the manual pulling instrument is between 30' and 60°.

11. The manual pulling instrument according to claim 9, wherein the hypothetical center plane is defined by minimizing a sum of the squares of distances between all points on the curved surface.

12. The manual pulling instrument according to claim 1, in which the second housing part comprises further operating elements, which are arranged in particular in an indentation formed by the second housing part, wherein in particular the further operating elements occupy a further spatial area of the manual pulling instrument.

13. The manual pulling instrument according to claim 8, wherein the concave curvature of the second boundary line of the further spatial area has, at least in sections, a radius of curvature which is between 15 cm and 35 cm.

14. The manual pulling instrument according to claim 1, in which the first housing part has an outer surface configured to be opposite the torso of the player when the manual pulling instrument is held as intended, wherein the outer surface has formed therein at least one sound exit aperture configured to emit a note generated by an actuation of the bellows.

15. The manual pulling instrument according to claim 14, in which the at least one sound exit aperture is the only exit aperture of the manual pulling instrument configured to emit notes generated by an actuation of the bellows.

16. A manual pulling instrument comprising:

a first housing part comprising operating elements with a planar surface which are configured to be operated by a player of the manual pulling instrument with the fingers of one hand pressing the planar surfaces;

a second housing part; and a bellows by which the first housing part and the second housing part are movably connected to each other;

wherein the planar surfaces of the operating elements occupy a spatial area extending in a curved surface, wherein the curved surface has a convex curvature or a concave curvature with respect to the first housing part.

17. The manual pulling instrument according to claim 16, wherein the curved surface is shaped such that the spatial area has the convex curvature in a central region of the spatial area with respect to a vertical direction.

18. The manual pulling instrument according to claim 16, wherein the curved surface is shaped such that the spatial area has the concave curvature in a lower region of the spatial area with respect to a vertical direction.

19. The manual pulling instrument according to claim 16, wherein the operating elements that occupy the spatial area extend to a first boundary line on a first side and to a second boundary line on a second side opposite the first side, wherein the second boundary line is further away from the bellows than the first boundary line, and wherein the second boundary line has a concave curvature.

20. The manual pulling instrument according to claim 16, further comprising a hypothetical center plane to which the curved surface is defined about, the hypothetical center plane is positioned at an angle of between 20° and 65° from a center plane of the manual pulling instrument which extends symmetrically with respect to the bellows between the first housing part and the second housing part when the bellows is in a folded state.

* * * * *